United States Patent [19]

Sasso

[11] Patent Number: 5,056,827

[45] Date of Patent: Oct. 15, 1991

[54] PHARMACEUTICAL LABEL

[75] Inventor: Theodore S. Sasso, Washington Township, Bergen County, N.J.

[73] Assignee: Challenge Printing Company, Wallington, N.J.

[21] Appl. No.: 302,019

[22] Filed: Jan. 25, 1989

[51] Int. Cl.[5] ..... B42D 15/00

[52] U.S. Cl. ..... 283/105; 283/81

[58] Field of Search ..... 283/105, 81; 40/310, 40/312

[56] References Cited

U.S. PATENT DOCUMENTS

| | | | |
|---|---|---|---|
| 1,273,105 | 7/1918 | Van Dyke et al. | 283/81 |
| 2,105,367 | 1/1938 | Parsons | 283/81 |
| 4,318,237 | 3/1982 | Augeri | 40/310 |
| 4,621,837 | 11/1986 | Mack | 283/105 |

*Primary Examiner*—Frank T. Yost

*Assistant Examiner*—Tom Hamill, Jr.

*Attorney, Agent, or Firm*—Mamorek, Guttman & Rubenstein

[57] ABSTRACT

A label for a pharmaceutical bottle is disclosed. Illustratively, the label comprises four sections. There is a first end-section having adhesive on its rear surface for adhering to the bottle. A second end-section spaced apart from the first end-section also has an adhesive rear surface for adhering to the bottle. A third relatively wide section is attached to the second end-section by means of a first perforation. A fourth relatively narrow section is attached between the first end-section and the third section by means of second and third perforations respectively. The fourth section includes a tab so that it can be easily removed by tearing along the second and third perforations. This permits the third section to be removed easily by tearing only along the first perforation.

6 Claims, 2 Drawing Sheets

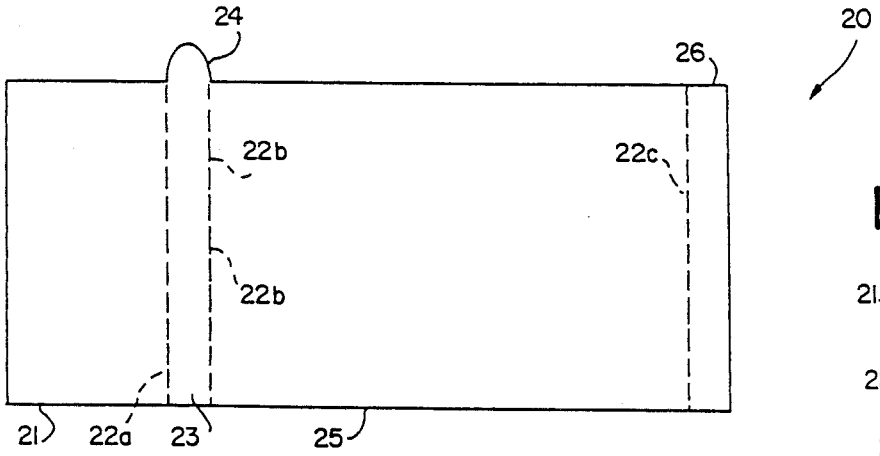
FIG. 2a
FIG. 2b
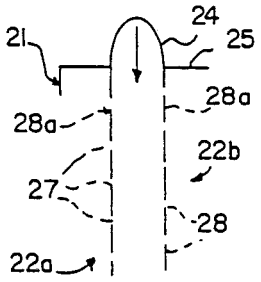
FIG. 2c
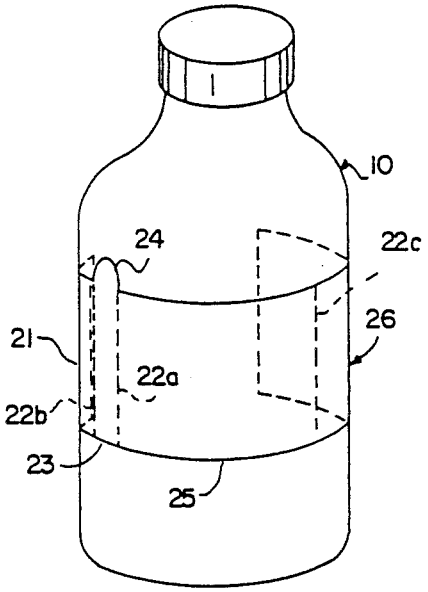
FIG. 2d
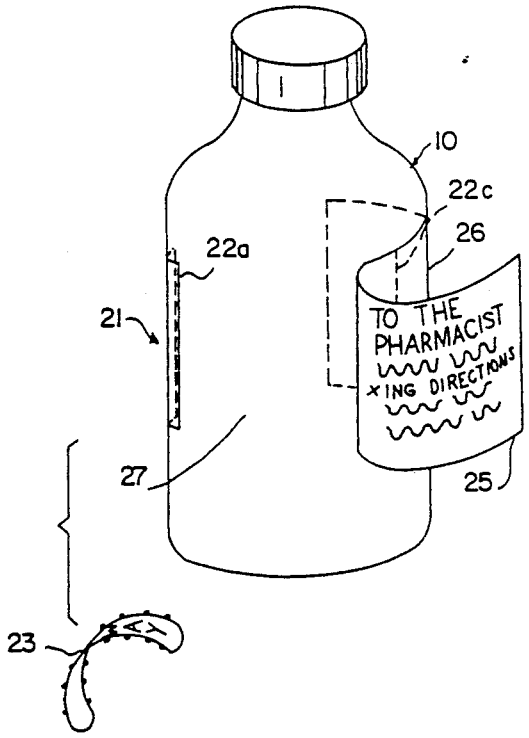

PHARMACEUTICAL LABEL

FIELD OF THE INVENTION

The present invention relates to a label for a container for a pharmaceutical or similar product.

BACKGROUND OF THE INVENTION

Some pre-packaged types of pharmaceuticals are marketed by drug manufacturers in unprepared form, that a pharmacist must prepare or reconstitute before dispensing. For example, certain suspensions of antibiotics such as amoxicillin are marketed as a dry powder which partially fills a sealed bottle. Thus, a pharmacist who stocks amoxicillin, stocks bottles containing a predetermined amount of dry powder. To fill a prescription, the pharmacist adds a predetermined amount of a liquid such as water to the bottle to reconstitute the suspension in accordance with preparation instructions printed on a manufacturer's label adhered to the bottle. The reconstituted prescription is then dispensed to the pharmacist's customer.

Typically, the manufacturer's label comprises three sections. There is a first end-section having an adhesive on its rear surface for adhering to the bottle and a second end-section having an adhesive on its rear surface for adhering to the bottle. Connected between the first and second end-sections is a relatively wide central section which has a non-adhesive rear surface. The central section is connected to the first and second end-sections by means of perforations. Typically, the front surface of the central section is printed with the name of the manufacturer, the manufacturer's trademark, a description of the pharmaceutical product contained in the bottle, dosage information and warnings for the pharmacist, as well as preparation instructions for the pharmacist.

Before dispensing the bottle, the pharmacist removes the central section of the manufacturer's label by tearing along the perforations. This results in a large area which the pharmacist uses to attach his own label. Typically, the pharmacist's own label includes the pharmacy name and telephone number, the prescription number, the prescribing physician's name, the pharmaceutical contained in the bottle, patient instructions, and other patient information such as warnings.

Unfortunately, the conventional three-section manufacturer's label described above has proven unsatisfactory for many pharmacists, the reason being that it is difficult for many pharmacists to grasp a portion of the non-adhesively backed central label section for easy tearing along the perforations connecting it to the two end sections. Instead of being easily removable as a single unit, the central section of the manufacturer's label tears too easily, typically in a random pattern, and is in general a nuisance for the pharmacist to remove.

SUMMARY OF THE INVENTION

The present invention is a label for a bottle containing a pharmaceutical or other substance. The inventive label is especially useful for certain suspensions which are marketed by drug companies in the form of dry powder which partially fills a sealed bottle.

In an illustrative embodiment, the inventive label comprises four sections. Thus, there is a first end-section having an adhesive rear surface for adhering to the bottle and a second end-section having an adhesive rear surface for adhering to the bottle. The third and fourth label sections are located between the first and second end-sections. The third section is a relatively wide central section which is connected to the second end-section by means of a first perforation. This third section has a non-adhesive rear surface s that it does not adhere to the bottle. The fourth section is a relatively narrow strip-shaped section which is located between the third central section and the first end-section. The fourth section has non-adhesive rear surface and is connected to the third section and the first end-section by means of second and third perforations, respectively. The fourth section includes a tab for easy gripping.

To remove the central label section, the narrow strip-shaped fourth section is removed by gripping the tab and tearing along the second and third perforations. Once the peel-away, strip-shaped fourth section is removed, the third (i.e. the central) label section swings free of the bottle but remains attached to the second end-section by means of the first perforation. The third section may now be removed easily by tearing along the first perforation.

In this manner, the central section may be removed easily and intact without the tearing, thereby overcoming a major defect of prior art labels. Since the central section may be removed intact, instructions for the pharmacist may be printed on its rear, thus enabling the front surface to be printed in a less crowded fashion, using, for example, a larger type size.

BRIEF DESCRIPTION OF THE FIGURES

FIG. 2*a* a removable label in accordance with an illustrative embodiment of the present invention.

FIG. 2*b* details of the grip tab method used in the label of FIG. 2*a*.

FIG. 2*c* the label of FIG. 2*a* attached to a pharmaceutical bottle.

FIG. 2*d* shows the label of FIG. 2*a* partially removed from the pharmaceutical bottle.

DETAILED DESCRIPTION OF THE FIGURES

Figure 1A:
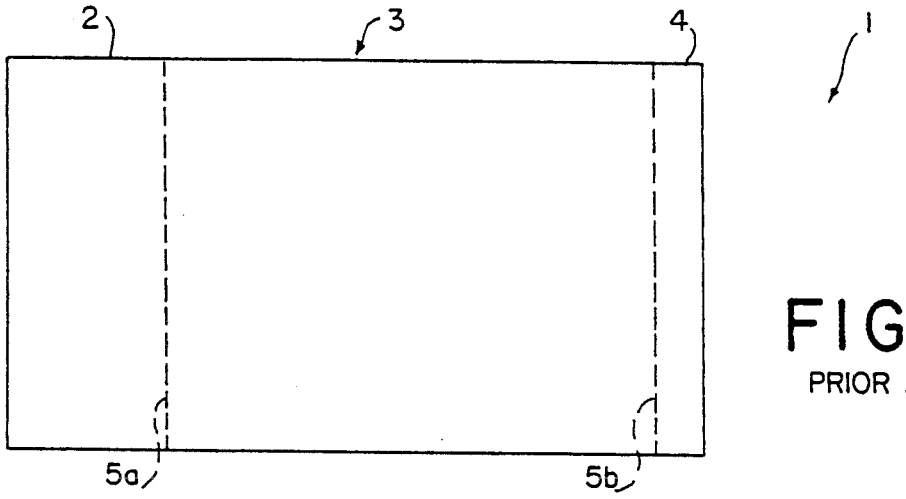
FIG. 1a PRIOR ART
FIG. 1*a* shows a prior art type of removable label.

FIG. 1*a* illustrates a prior art removable label 1 intended for affixation to a container or bottle for a pharmaceutical preparation such as a suspension to be reconstituted by the pharmacist.

Label 1 comprises three sections, left end-section 2, right end-section 4, and removable central section 3. Left end-section 2 is an adhesive backed section that serves to adhere the left end of the label 1 to the container. Left end-section 2 terminates at perforation 5*a*. Illustratively, the left end-section 2 is imprinted with storage instructions for the reconstituted suspension, a space wherein the pharmacist can write the date of reconstitution, user instructions, the identity of the suspension, the name and address of the manufacturer, and the product or batch identification number. The central section 3 is the removable portion of label 1. It has no adhesive backing and therefore will not adhere to the container. Alternatively, the section 3 is originally formed with an adhesive backing which is later deactivated. Central section 3 is imprinted with product identification data, the manufacturer's name and trademark, etc. The central section 3 of the label is also imprinted with messages to the pharmacist and with the mixing directions the pharmacist needs to prepare or reconstitute the suspension or other product in the container. The central section 3 terminates at perforation 5b. Right end-section 4 is adhesively backed and will adhere to the container. Section 4 serves to adhere the right-end of label 1 to the container, and will remain on the container after central section 3 of the label is removed to leave room for the pharmacy's prescription label.

Figure 1B:
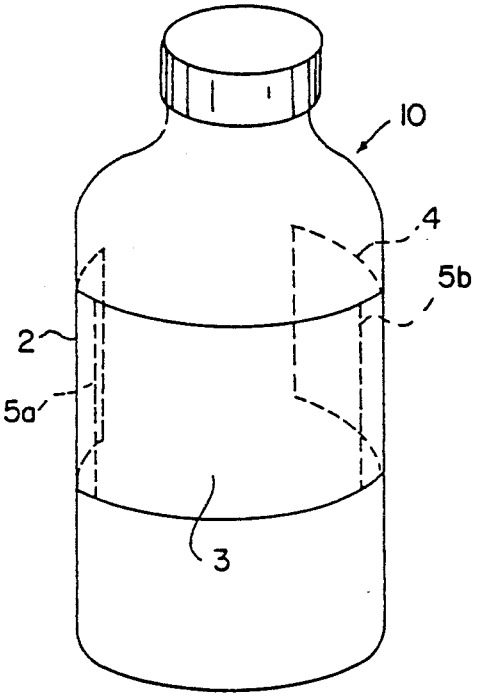
FIG. 1b PRIOR ART
FIG. 1*b* shows a label of the type shown in FIG. 1*a*, attached to a pharmaceutical bottle.

FIG 1b shows the label of FIG. 1a affixed to a container or bottle 10. After reading the label's message, and following its instructions for preparing the container's contents for dispensing, the pharmacist must remove label section 3, to leave room to affix the pharmacy's standard prescription label.

Figure 1C:
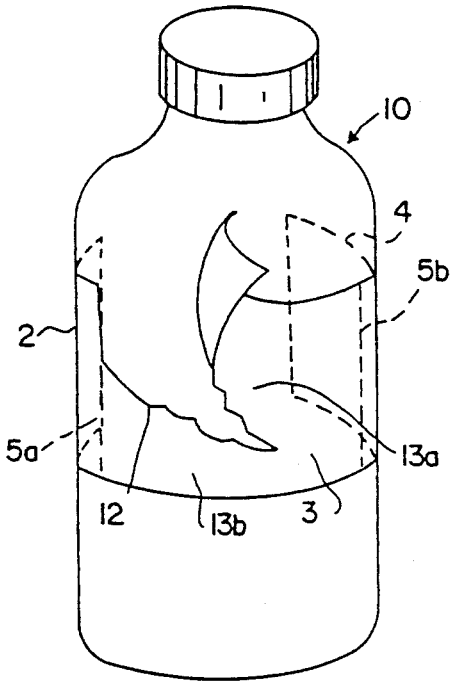
FIG. 1c PRIOR ART
FIG. 1*c* shows how the central part of this type of label tends to tear when one attempts to remove it.

As indicated above, one problem with the label 1 of FIGS. 1a, 1b, and 1c, is that the label is difficult to remove. In particular, instead of each separating from the end sections 2, 4 along the perforations 5a and 5b, the central section 3 tends to tear randomly.

FIG. 1c shows how central section 3 tears into pieces, here, illustratively, pieces 13a and 13b, when an attempt is made to remove it intact.

Thus, as indicated above, the label 1 of FIGS. 1a, 1b, 1c is difficult and inconvenient for the pharmacist to use. FIG. 2a illustrates a label produced in accordance with the present invention. It comprises four sections. The left end-section 21 is adhesively backed, and serves to adhere that end to a container. Illustratively, the section 21 is imprinted with patient instructions, a batch or product number, and a notice to the pharmacist as to where instructions for reconstitution or preparation can be found (e.g. on the reverse side of the central section 25 as discussed below). Section 21 terminates at perforation 22a. Section 23 comprises a peel-away strip with a grip tab 24. Section 23 is not adhesively backed, and it terminates at perforation 22b. Central section 25 is imprinted on its front surface with the product identification and dosage data, the manufacturer's name and trademark, any necessary cautions and warnings, and perhaps a bar code. Illustratively, its reverse side, section 25 is imprinted with messages to the pharmacist and/or with directions for preparing or reconstituting the product for use (see FIG. 2d). Thus, while use of the inventive label 20 makes printing on the reverse side more feasible, in particular embodiments of the inventive label, there may be no printing on the reverse side. Section 25 is not adhesively backed, and is instead intended to be removed to leave space for affixing the pharmacy's own standard type of prescription label. Section 25 terminates at perforation 22c. Alternatively, sections 23 and 25 may originally be formed with adhesive backing which is later deactivated for example by placing a UV sensitive coating over the adhesive and curing the coating with UV light.

Right end-section 26 is adhesively backed and is intended to adhere to the bottle or container.

FIG. 2b shows a detailed view of the peel-away strip (i.e. section 23) of FIG. 2a. Note that perforations 22a and 22b comprise long slits 27 connected by short segments of unslit paper 28, making the strip easy to tear away. The grip tab 24 extends to the topmost paper segment 28a of the perforations 22a, 22b, so that the grip tab 24 is approximately one-half inch long.

FIG. 2c shows the label of FIG. 2a affixed to a container 10. FIG. 2d shows how easily central section 25 of this label may be removed intact. Note that the nonadhesively backed peel-away strip 23 is torn cleanly away along the perforations 22a, 22b using the grip tab 24 which may now be discarded. Since it is no longer attached to the rest of the label by perforation 22b, nonadhesively backed central section 25 of the label swings free, revealing the printing (e.g., instructions to the pharmacist) on its reverse side. Central section 25 remains attached to the rest of the label only along perforation 22c, which now acts as a supporting hinge. By simply tearing central section 25 along perforation 22c, it is removed cleanly and intact so instructions or other material printed on the reverse side can be conveniently read by the pharmacist. Its removal also leaves a clear area 27 upon which the pharmacist can affix the pharmacy's standard prescription label.

It should be noted that use of the reverse side of central label section 25 for printing instructions or other material, an unused and heretofore wasted resource in prior-art labels, leaves more room on the front of label section 25. This additional space may be used to imprint a bar-code, a manufacturer's trademark, etc. or the label may be printed using a larger type and/or in a less crowded fashion.

It should also be noted that in a particular embodiment of the inventive label 20 of FIG. 2, the positions of the sections 23 and 25 may be reversed so that the strip 23 borders the section 26 and the central section 25 borders the section 21.

In all then, from the standpoints of convenience, ease of label removal, and availability of ample printing space on the front of the label, the type of removable label disclosed herein represents a major improvement over prior art labels intended to be used in similar applications.

Finally, the above-described embodiments of the invention are intended to be illustrative only. Numerous alternative embodiments may be devised by those skilled in the art without departing from the spirit and scope of the following claims.

What is claimed is:

1. A label for a bottle containing a pharmaceutical, having a top and a bottom edge, comprising a first end-section having an adhesive backing for adhering to said bottle, a second end-section spaced apart from said first section and having an adhesive backing for adhering to said bottle, a third relatively wide section having no adhesive backing and connected to said second end-section by means of a first perforation extending from said bottom edge to said top edge, and a fourth relatively narrow section having no adhesive backing and connected between said first end-section and said third section by means of second and third perforations extending from said bottom edge to said top edge, said fourth section including tab means so that said fourth section may be easily removed by tearing along said second and third perforation and so that said third section can be removed by tearing only along said first perforation.

2. The label of claim 1 wherein said tab means is formed integrally with said fourth section.

3. The label of claim 1 wherein said third and fourth sections have deactivated adhesive on their rear surfaces.

4. The label of claim 1 wherein pharmacist instructions are printed on the back of the third section.

5. A label for a container, having a top and a bottom edge, comprising a first end-section having adhesive on its rear surface for adhering to said container, a second end-section having adhesive on its rear surface for adhering to said container, a third section having a non-adhesive rear surface and removably attached to said second end-section by perforation means extending from said bottom edge to said top edge, a fourth relatively narrow section having a non-adhesive rear surface located between said first end-section and said third section and removably attached, by perforation means extending from said bottom edge to said top edge, to said first end-section and said third section, and tab means associated with said fourth section for detaching said fourth section from said second end-section and said third section.

6. A label for a container, having a top and bottom edge, comprising a first end-section having adhesive on its rear surface for adhering to said container, a second end-section having adhesive on its rear surface for adhering to said container, a third section having a non-adhesive rear surface and attached to said second end-section by means of a first perforation extending from said bottom edge to said top edge, and means attached between said first end-section and said third section via second and third perforations extending from said bottom edge to said top edge, respectively, for enabling easy removal of said third section.

* * * * *